US007855688B2

(12) United States Patent
Schipper et al.

(10) Patent No.: US 7,855,688 B2
(45) Date of Patent: Dec. 21, 2010

(54) REMOVABLE MOUNTING DEVICE FOR ANTENNA

(75) Inventors: Michael Jack Schipper, Murphy, TX (US); Max Alan Probasco, Plano, TX (US)

(73) Assignee: AirGizmos, LP

( * ) Notice: Subject to any disclaimer, the term of this patent is extended or adjusted under 35 U.S.C. 154(b) by 812 days.

(21) Appl. No.: 11/811,409

(22) Filed: Jun. 11, 2007

(65) Prior Publication Data

US 2008/0303740 A1 Dec. 11, 2008

(51) Int. Cl.
*H01Q 1/32* (2006.01)
*H01Q 1/42* (2006.01)

(52) U.S. Cl. ..... 343/713; 343/872

(58) Field of Classification Search ..... 343/713, 343/700 MS, 872

See application file for complete search history.

(56) References Cited

U.S. PATENT DOCUMENTS

| | | | | |
|---|---|---|---|---|
| 4,749,999 | A * | 6/1988 | Hayashi | 343/713 |
| 5,900,840 | A * | 5/1999 | Yajima | 343/713 |
| 6,288,684 | B1 | 9/2001 | Wiggenhorn et al. | |
| 6,469,678 | B1 * | 10/2002 | Pullen | 343/888 |
| 6,686,809 | B2 | 2/2004 | Nystrom et al. | |
| 7,002,523 | B2 | 2/2006 | Noro | |

* cited by examiner

*Primary Examiner*—Shih-Chao Chen
(74) *Attorney, Agent, or Firm*—Keith E. Taber; Klemchuk Kubasta LLP

(57) ABSTRACT

A mounting device for an antenna device and its method for mounting, and removing the antenna utilizes a dock unit and a base unit. In addition to providing a mounting mechanism, the capture or mounting of the device incorporates a storage feature for the antenna cable to make it transportable. The apparatus provides a means for connecting an antenna to a housing, storing a cable in the housing, and capturing the housing to a docking mechanism while allowing for easy removal of the antenna, and cable storage feature.

8 Claims, 5 Drawing Sheets

REMOVABLE MOUNTING DEVICE FOR ANTENNA

FIELD OF THE INVENTION

The invention relates a mounting device for an antenna, and more particularly to a removable mounting device for an antenna for use with portable electronic devices.

BACKGROUND OF THE INVENTION

The following three patents are use to illustrate the state of the art, but do not define anything which would prevent the patenting of the present invention.

U.S. Pat. No. 6,686,809 describes an antenna unit for a car navigation device includes a unit casing accommodating a circuit board and an antenna body and having a bottom cover in which a bottom recess is formed. A permanent magnet ring magnetically held on a back yoke is fixedly set in the bottom recess, the permanent magnet ring being used to magnetically hold the bottom cover on the surface of an object so that the antenna unit is detachably mounted on the object. In the antenna unit, an adhesive seal is bonded to the of the permanent magnet ring which surface confronts the surface of the object.

U.S. Pat. No. 7,002,523 describes an antenna device comprising an antenna element, and a bottom cover and a top cover which cover the antenna element. The bottom cover includes a base projection to be inserted into an opening formed in a mounting part, a washer having an elastic force being fitted over this base projection, and the washer comes into contact with an inner face of the mounting part thereby enabling the antenna device to be mounted and fixed. The washer is inserted into the opening in the mounting part in a state fitted over the base projection, and recovered to its original shape by the elastic force after the insertion, thereby to be brought into contact with the inner face of the mounting part.

U.S. Pat. No. 6,288,684, describes amounting apparatus (100) suitable for retaining an antenna (112) includes a base (102) having magnetic sources (104) and (106) capable of providing varying magnetic forces. Magnet (104) retains the base against a metal surface (410), while an electronically controlled magnet (106) provides additional retention of the base (102) against the metal surface (410) when activated, thereby preventing movement of the base and antenna (112).

Electronic devices that obtain information from a remote source typically receive that information though a wireless transmission medium. Information that is transmitted to outdoor and/or remote locations will usually be through radio frequency transmission. Some electronic devices that use antennae integrate the antenna into the device enclosure such as personal cellular phones which makes them highly portable. For proper reception of radio signals, an antenna may require placement away from interfering shielding, electronic noise sources, or require improved line of sight to the source antenna. Remote antenna placement typically uses cables and antenna mounting structures. Automobile, boat, and aircraft antenna have been used and mounted in a variety of methods. Mounts have attached to the frames, mirrors, windows, dash boards, and other area. As devices become increasingly portable and multi functional, the user desires to have an integrated antenna, multiple antennae, or a transportable antenna to maintain full functionality and portability of their devices. Antenna mounts with a magnetic base such as Yajima 1996 are used in applications where the mount is temporary and the installation does not use tools which results in the mounting process being easy for the installer. The use of a magnetic mount provides the user with a portable solution without the use of tools to remove the antenna. Although providing simplicity, magnetic antenna mounts do not meet the requirements in many aircraft, boat, and even automotive applications. Differing material that are non-ferrous such and aluminum skins of aircraft and composite fiber of aircraft and boats do not provide sufficient magnetic attraction. Additionally, high speed winds on vehicles break the hold of a magnetic mount. An alternative is to mount the antenna internal to a moving vehicle to avoid wind forces and to shorten cable lengths for cable management. Satellite navigation systems and satellite broadcast radios are two examples of radio devices that can receive sufficient signals when the antenna is mounted on the interior of a vehicle with a line of sight to the sky. A dashboard mount can solve problems associated with wind and will shorten cable lengths. Unfortunately in navigation equipped vehicles such as aircraft and boats, the use a magnetic mount will interfere with magnetic compasses in the vicinity of a dash mounted antenna. Remaining options for dash board mounting the antenna include permanent fasteners such as screws, adhesive, and hook and loop fasteners.

Having multiple permanent antenna installations would allow the electronic equipment to be used in multiple locations therefore partially meeting the portability requirement yet resulting in an increased cost to the user. Additional cost may be incurred on antenna systems that use a multi-functional antenna and antenna that have integrated electronics. These antenna devices are higher cost in both purchase price and use price. An antenna that integrates a satellite radio system with an antenna would have a subscription price associated with each satellite radio that resides internal to the antenna structure.

For usability and cost saving, the requirements for an antenna mounting structure associated with portable electronics are to have a mounting system that allows for easy removal of the antenna, proper cable management, ease of placement, movement from sites without tools, and little or no reliance on magnetic attachment.

SUMMARY OF THE SYSTEM AND METHOD

The invention is a mounting device for an antenna device and to a method for mounting, and removing the antenna. In addition to providing a mounting mechanism, the capture or mounting of the device incorporates a storage feature for the antenna cable to make it transportable. In this embodiment, the apparatus provides a means for connecting an antenna to a housing, storing a cable in the housing, and capturing the housing to a docking mechanism while allowing for easy removal of the antenna, and cable storage feature.

BRIEF DESCRIPTION OF THE DRAWINGS

Reference is now made to the following detailed description of the described embodiments, taken in conjunction with the accompanying drawings. It is emphasized that various features may not be drawn to scale and selected views are selected for clarity of discussion and may not show all of the features that are present. Reference is now made to the following descriptions taken in conjunction with the accompanying drawings, in which.

DETAILED DESCRIPTION OF A PREFERRED EMBODIMENT

A mounting and capture mechanism for an antenna comprising of a dock and a base wherein the dock and base can be disconnected for antenna portability. The base attaches to the antenna and provides a means for holding the antenna cable and cable connector. A dock mechanism provides a means for connecting to the base and attaching the resulting assembly to a surface. For the purpose of this disclosure, an aircraft instrument panel dashboard will be used as an example. Installation may be intuitively extended to any surface used for mounting an antenna including brackets for interior mounting.

The proposed methods will be using a dock and base made from plastic material and attached to the supporting surface by screws. However, the materials and attachment means may easily be constructed of other materials.

In a first embodiment, the base mechanism attaches to the antenna and holds a first cable comprising of at least one connector from the antenna for routing a connection internal to base so that the antenna may be transportable. A first cable may be a short cable that connects to the antenna or the first cable may be a permanent cable that is integrated into the antenna assembly. The base is attached to the antenna by any means the manufacturer of the antenna provides such as screws, locking mechanisms, threads, tape, or clips. Other means of attachment include but are not limited to adhesives, hook and loop fasteners and material bonding. A second cable comprising at least one connector is attached to the first cable connector to complete the circuit between the electronic device and the antenna.

Figure 1:
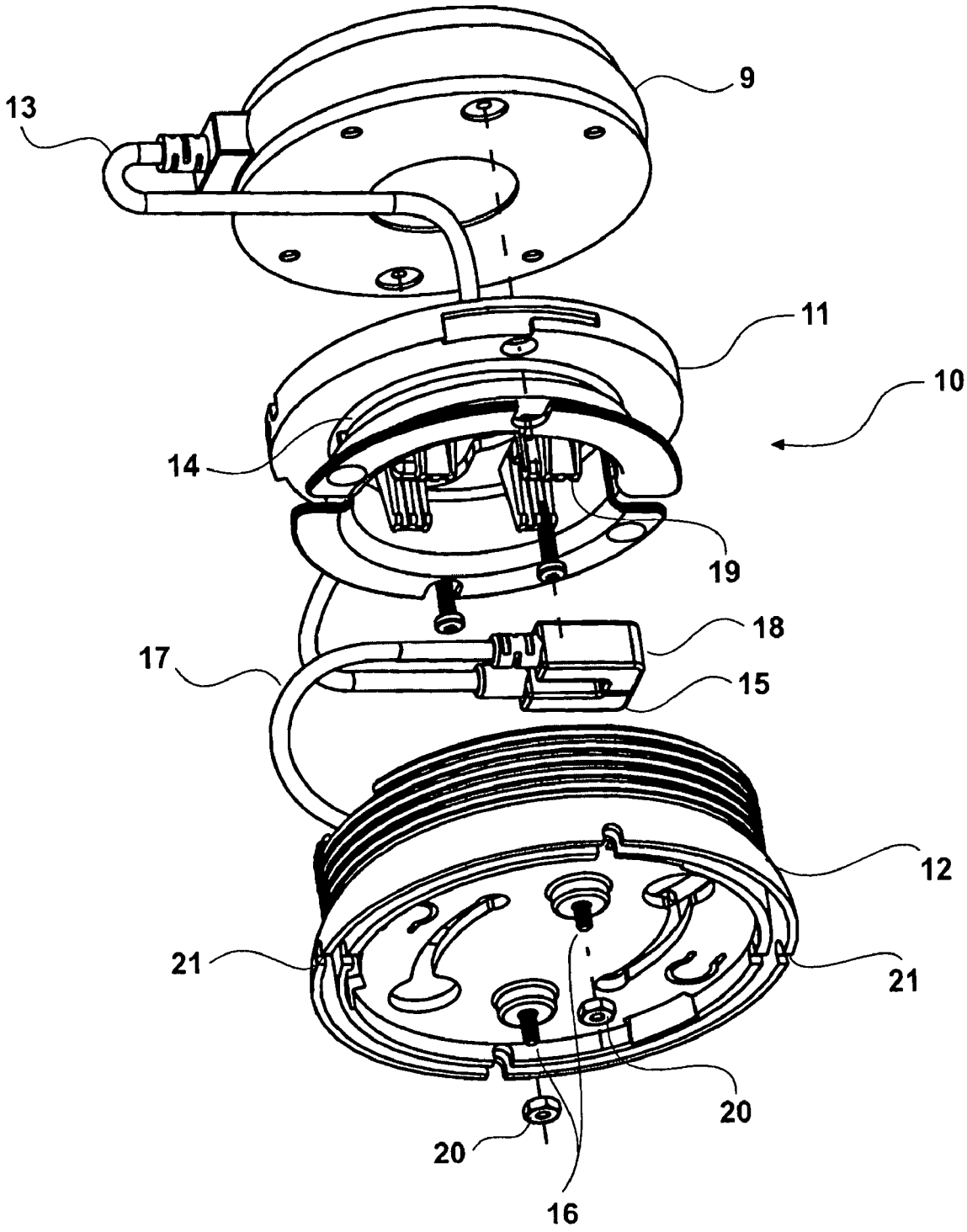
FIG. 1 illustrates an exploded view of and antenna and an antenna mounting system, which uses a dock and cable spool.

FIG. 1 illustrates an antenna mounting mechanism using a base 11 and dock 12 and the corresponding antenna 9. The mounting mechanism 10 is comprised of a base 11 and a dock 12. First cable connector 15 is captured internal to the base 11 and the first cable 13 is wound and collected in the base spool grove 14. Once the first cable 13 is captured and the antenna 9 secured to the base 11, the antenna 9, base 11 and cable 13 comprise a self contained and transportable assembly. Dock 12 connects to base 11 and holds it in place. A second cable 17 and connector 18 originates from the electronic device (not illustrated) and is routed into dock 12. Cable 17 may be routed from beneath base 12, through an opening in the mounting surface, or through a side slot 21. Side slots 21 may be used to the cable when holes beneath base 12 are not desired or feasible. Connector 18 attaches to connector 15 to complete the connection between the antenna 9 to the electronic device. Connectors 18 and 15 are retained in place by capture fingers 19. Screws 16 and nuts 20 are used to connect dock 12 to a surface that will support the mounting device and the antenna 9. Dock 12 may be secured with other methods comprising tape, glue, hook and loop fasteners or simply left unsecured depending on the user application.

Figure 2A:
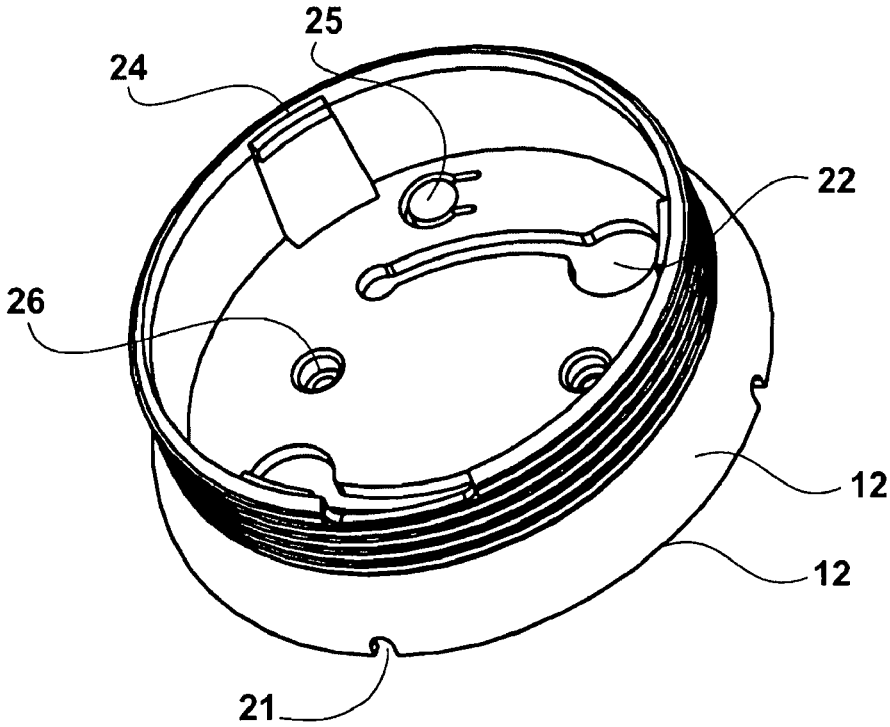
FIG. 2A-2B illustrates the dock structure of an antenna mounting system showing internal features.
Figure 2B:
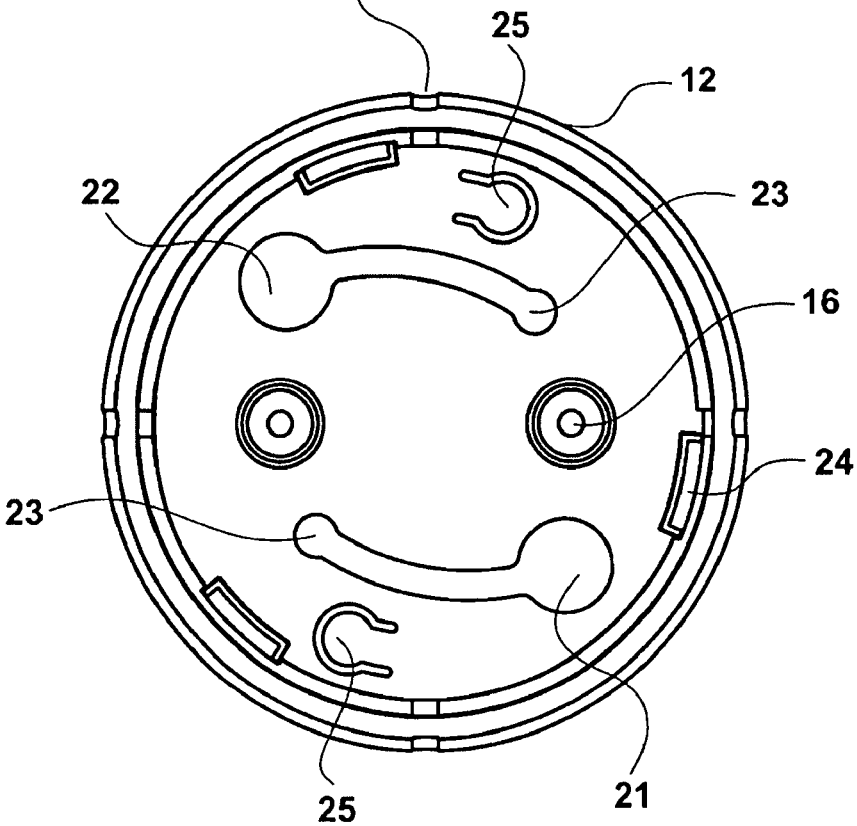

FIG. 2A illustrates the features of dock 12 in a perspective view, and FIG. 2B illustrates the features of dock 12 from a bottom view. The second cable 17 and connector 18 can be routed from beneath the dock through the opening 22. Once the connector 18 has passed though opening 22, cable 17 is slid to hole 23 where the opening is smaller than connector 18. Connector 18 is therefore restricted from passing back though the opening. Preventing the second cable and associated connector from falling back though the mounting device is important while connector 15 and connector 18 are disengaged such as when the base 11 has been transported to another location. When the antenna 9 and base 11 return, the accessibility of the cable provides for easy re-attachment and engagement to the dock. Although the slot in this embodiment is a straight slot from the connector pass though hole 22 to the cable resting hole 23, the design of the keyhole could be angled, spiral, or other shapes depending on the connector position and designers preferences. Tabs 24 are used to position and indents 25 secure base 11 inside of dock 12 cavity. Holes 26 are where screws 16 are used to attach the base to a surface.

Figure 3:
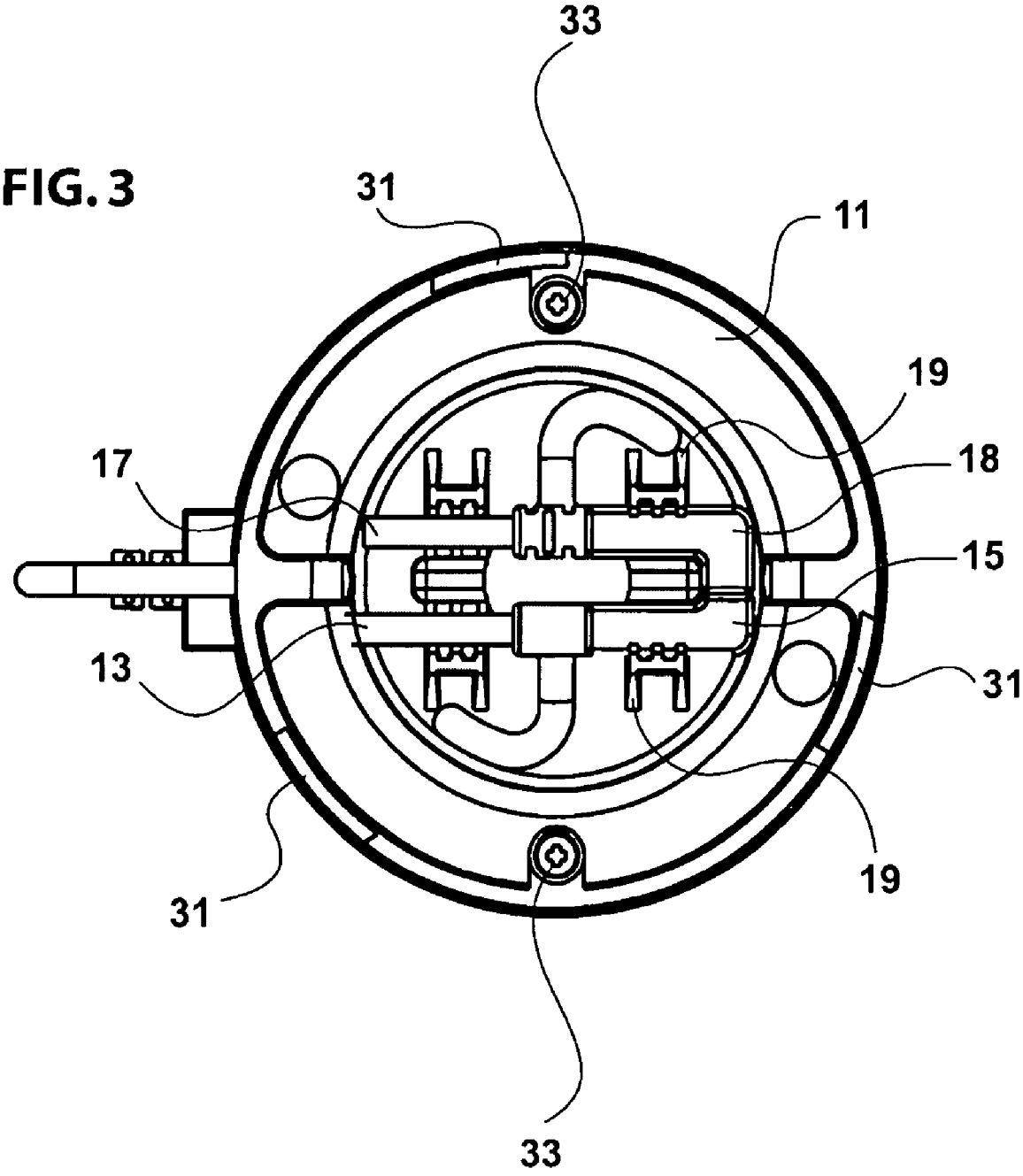
FIG. 3 illustrates the base structure of an antenna mounting system showing internal features.

FIG. 3 illustrates a bottom view of base 11. Slots 31 are located in base 11 to correspond to tabs 24 of dock 12. Base 11 is inserted into the dock 12, aligned to the tabs and rotated until the tabs catch in the slots 31 of base 11. Flexible locks 25 (FIG. 2*b*) provide pressure to aid in capture. Once captured, base 11 is prevented from lifting out of dock 12 and the components acts as a single assembly. To aid in base capture locking mechanisms such as detents, friction locks and tongue and grove may be used at the discretion of the designer. Such mechanisms are common and obvious to a knowledgeable mechanical designer. Cable 17 connector 18 and cable 13 connector 15 are joined together and held in place by capture fingers 19. Screws 33 are attached to the antenna module and the mounting method will vary between antenna manufacturers.

Figure 4A:
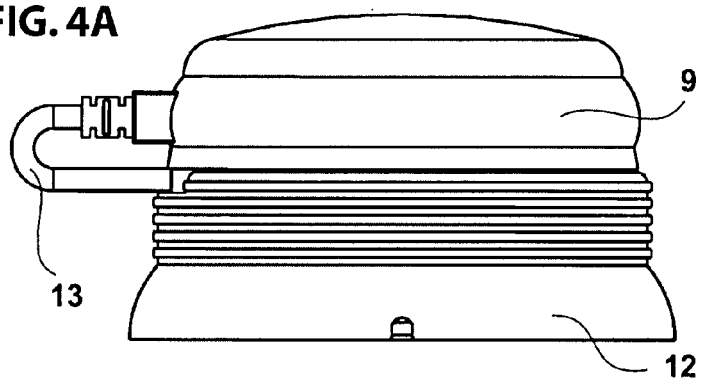
FIGS. 4*a*, 4*b* and 4*c* show an example of an antenna mounted on the antenna mounting system of FIGS. 1-3.
Figure 4B:
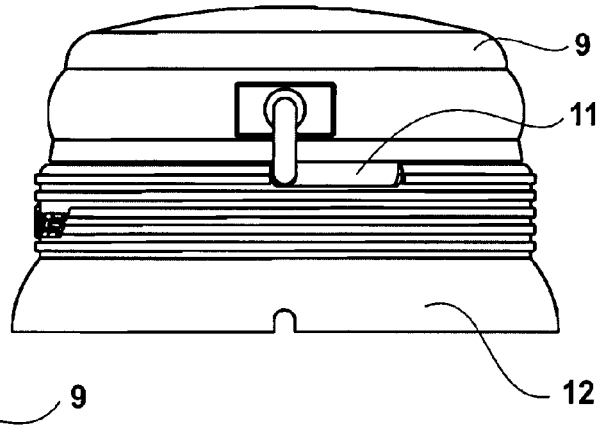
Figure 4C:
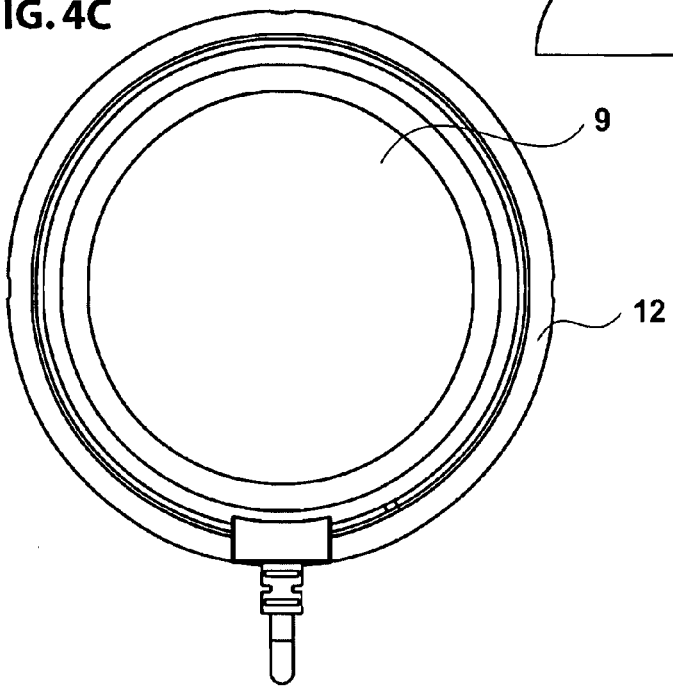

FIGS. 4*a*, 4*b*, and 4*c* are side, end and top views of Antenna 9 assembled with base 11 and dock 12. Cable 13 from Antenna 9 is shown entering base 11 where it is wound around internal groove 14 shown in FIG. 1.

Figure 5:
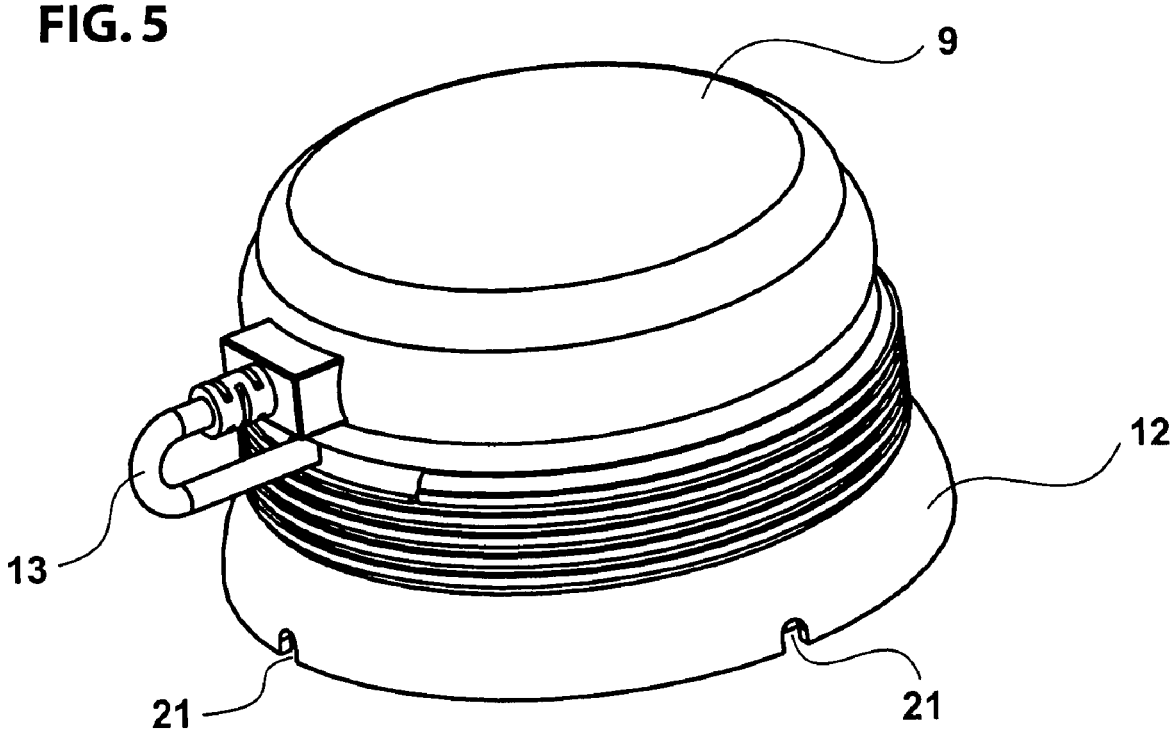
FIG. 5 is a isometric view of the antenna mounted on the antenna mounting system.

FIG. 5 is an isometric view of the antenna assembly showing the antenna 9 and dock 12. Cable 13 from antenna 9 enter an opening in base 11. A cable from an electronic device (not illustrated) can be routed through openings 21 of dock 12 or may enter under dock 12 though opening 21 (FIG. 2A and FIG. 2B).

For the purpose of this disclosure, devices using cables to connect to antenna are described. Some integrated antenna devices are self contained and may receive information on certain frequencies and retransmit information to other equipment by infrared or different radio signals without the use of a cable. Variation of the embodiments described can be used as mounting systems for such wireless systems. The embodiment examples presented serve to convey additional complexities that are solved and the use of wired devices does not limit the scope of the device that can be mounted using the systems described.

What is claimed is:

1. A mounting device for removably mounting an antenna to a mounting surface, and hold connecting cables, comprising:

a dock unit for mounting to a surface;

a base unit for attaching an antenna to the dock unit;

groove in the base unit for holding a cable which attaches the antenna to an electronic device; and including a fastening device in the dock unit for securing joined connectors, one from the antenna and the other from the electronic device.

2. A mounting device according to claim 1, wherein the base unit is secured to the antenna, and is removably attached to different dock units at different locations.

3. A mounting device according to claim 1, wherein a cable from an electronic device is routed into the dock unit from one of an opening in a bottom side of the dock unit and a slot opening in a side of the dock unit.

4. A mounting device for removably mounting an antenna to a mounting surface, and hold connecting cables, comprising:

a dock unit for mounting to a surface;

a base unit for attaching an antenna to the dock unit;

groove in the base unit for holding a cable which attaches the antenna to an electronic device; and wherein the cable which attaches the antenna to an electronic device cable is wound around and placed in the groove in the base unit.

5. A mounting device for removably mounted an antenna to a mounting surface, and hold connecting cables, comprising:

a dock unit for mounting to a surface:

a base unit for attaching an antenna to the dock unit:

groove in the base unit for holding a cable which attaches the antenna to an electronic device; and a fastening device in the dock unit for securing joined connectors, one from the antenna and the other from the electronic device.

6. A mounting device according to claim 5, wherein the base unit is secured to the antenna, and is removably attached to different dock units at different locations.

7. A mounting device according to claim 5, wherein a cable from an electronic device is routed into the dock unit from one of an opening in a bottom side of the dock unit and an opening in a side of the dock unit.

8. A mounting device according to claim 5, wherein the cable which attaches the antenna to an electronic device cable is wound around and placed in the groove in the base unit.

* * * * *